US008899210B2

(12) United States Patent
Abe et al.

(10) Patent No.: US 8,899,210 B2
(45) Date of Patent: Dec. 2, 2014

(54) DRIVE CIRCUIT FOR ELECTROMAGNETIC FUEL-INJECTION VALVE

(75) Inventors: Motoyuki Abe, Hitachinaka (JP); Tohru Ishikawa, Kitaibaraki (JP); Takuya Mayuzumi, Hitachinaka (JP); Tetsuo Matsumura, Hitachinaka (JP)

(73) Assignee: Hitachi Automotive Systems, Ltd., Hitachinaka-shi (JP)

( * ) Notice: Subject to any disclaimer, the term of this patent is extended or adjusted under 35 U.S.C. 154(b) by 340 days.

(21) Appl. No.: 13/512,406

(22) PCT Filed: Aug. 16, 2010

(86) PCT No.: PCT/JP2010/063805

§ 371 (c)(1),
(2), (4) Date: May 29, 2012

(87) PCT Pub. No.: WO2011/065072

PCT Pub. Date: Jun. 3, 2011

(65) Prior Publication Data

US 2012/0234299 A1 Sep. 20, 2012

(30) Foreign Application Priority Data

Nov. 30, 2009 (JP) ..... 2009-270971

(51) Int. Cl.

| | |
|---|---|
| ***F02M 51/00*** | (2006.01) |
| *F02D 41/40* | (2006.01) |
| *F02D 41/20* | (2006.01) |

(52) U.S. Cl.

CPC ..... *F02D 41/20* (2013.01); *F02D 41/402* (2013.01); *F02D 2041/2003* (2013.01)

USPC ..... 123/490; 123/299; 123/478; 123/480; 701/103; 701/104

(58) Field of Classification Search

USPC ..... 123/299, 472, 478–480, 490; 239/585.1–585.5, 900; 335/220, 279, 335/281; 701/103, 104

See application file for complete search history.

(56) References Cited

U.S. PATENT DOCUMENTS 4,774,624 A * 9/1988 Qualich ..... 361/159
6,360,725 B1 * 3/2002 Scherrbacher ..... 123/490

(Continued)

FOREIGN PATENT DOCUMENTS

CN 101568713 A 10/2009
JP 5-296120 A 11/1993

(Continued)

OTHER PUBLICATIONS

Chinese Office Action dated Nov. 5, 2013 (three (3) pages).

(Continued)

*Primary Examiner* — Thomas Moulis
*Assistant Examiner* — Joseph Dallo
(74) *Attorney, Agent, or Firm* — Crowell & Moring LLP

(57) ABSTRACT

A drive circuit for driving an electromagnetic fuel-injection valve, the drive circuit varying an application sequence of a drive voltage, which is supplied from a step-up power supply to a fuel-injection valve for conducting injection multiple times in a single stroke of an internal-combustion engine, between the first injection and the second and subsequent injections, and setting the application sequence such that the consumption of power from the step-up power supply in the first injection becomes smaller than the power consumption in one of the second and subsequent injections.

14 Claims, 7 Drawing Sheets

(56) References Cited

U.S. PATENT DOCUMENTS

| | | | | |
|---|---|---|---|---|
| 6,557,532 | B1 * | 5/2003 | Nakayama et al. | 123/490 |
| 6,880,519 | B2 * | 4/2005 | Nakayama et al. | 123/295 |
| 7,621,259 | B2 * | 11/2009 | Mayuzumi | 123/490 |
| 7,917,310 | B2 | 3/2011 | Pearce et al. | |
| 8,065,070 | B2 * | 11/2011 | Czekala et al. | 701/103 |
| 8,081,498 | B2 * | 12/2011 | Mayuzumi et al. | 363/59 |
| 2008/0276907 | A1 | 11/2008 | Abe et al. | |
| 2009/0063014 | A1 * | 3/2009 | Tokugawa et al. | 701/103 |
| 2010/0186718 | A1 | 7/2010 | Klein et al. | |

FOREIGN PATENT DOCUMENTS

| | | | |
|---|---|---|---|
| JP | 2008-280876 | A | 11/2008 |
| JP | 2009-121482 | A | 6/2009 |

OTHER PUBLICATIONS

International Search Report with English translation dated Oct. 12, 2010 (two (2) pages).

Chinese Office Action dated Jun. 24, 2014 (6 pages).

* cited by examiner

DRIVE CIRCUIT FOR ELECTROMAGNETIC FUEL-INJECTION VALVE

TECHNICAL FIELD

The present invention relates to a drive circuit for an electromagnetic fuel-injection valve, the drive circuit driving a valve element by means of an electromagnet.

BACKGROUND ART

JP-A-2008-280876 discloses a method, wherein immediately after a valve element becomes in a closed valve state after completing energization from an open valve state, the energization of a coil is resumed, and a magnetic attraction force in a direction to attract the valve element biased in a valve-closing direction and a movable element is generated in advance in preparation for reopening the valve, thereby conducting injection multiple times at relatively short time intervals.

JP-A-5-296120 discloses an example, wherein as a conventional art, the same application sequence of a drive voltage is performed in multiple injections, and wherein the current value used for driving varies between the first injection and the second injection.

CITATION LIST

Patent Literature

PATENT LITERATURE 1 JP-A-2008-280876
PATENT LITERATURE 2 JP-A-5-296120

SUMMARY OF INVENTION

Technical Problem

The conventional art discloses a method, wherein in order to promptly reopen a valve, the energization is resumed immediately after closing the valve, thereby stabilizing the operation of a movable element. However, in view of the usage condition of a combustion engine, there is a problem that if the number of times of injection in a single stroke reaches multiple times, the number of times of energization from a boosted power source (a step-up power supply) to a fuel-injection valve will increase and also the amount of the current from the step-up power supply to the fuel-injection valve will increase and thus the power consumption in the step-up power supply will increase.

The step-up power supply usually comprises a booster circuit comprising an inductive element and a switching element, and a capacitor for storing the boosted power. When energizing from the step-up power supply to a fuel-injection valve, the power is supplied to the fuel-injection valve by discharging the power stored in the capacitor. Then, the terminal voltage of the capacitor will drop due to the discharge.

The capacitor, after being discharged, is charged by the booster circuit and returns to a predetermined boosted voltage. However, when multiple injections are performed in a relatively short time period, the booster circuit may not be able to complete the charging of the capacitor for the second and subsequent injections. Moreover, if injection is conducted multiple times in a single stroke, the amount of the current from the step-up power supply to the fuel-injection valve will increase and the power consumption in the step-up power supply will increase as described above, and accordingly the power required to charge from the booster circuit will also increase.

For this reason, heat generation of the switching element often increases, causing design difficulties, or the flexibility of layout of the switching element often needs to be sacrificed for the purpose of cooling. Moreover, a method may be contemplated for increasing the capacity of the capacitor in order to suppress the influence from the voltage drop. However, the problem of the flexibility of layout of the switching element is likely to occur, and there is also a problem of high cost.

In the conventional art, a sufficient consideration has not been given to such problems related to the drive circuit and the method of avoiding these problems. Moreover, as disclosed in JP-A-5-296120, while a method is disclosed for varying the application sequence of a drive voltage between the first injection and the second injection during multiple injections, a sufficient consideration has not been given to a method of conducting the second and subsequent injections at higher speed during multiple injections and reducing the load on the drive circuit.

On the other hand, for the purpose of suppressing the bounce of the valve element after closing the valve or of improving the controllability of the minimum injection quantity, the main body of the fuel-injection valve is often configured so that the movable element and the valve element are movable independently from each other, as shown in JP-A-2008-280876.

In such a configuration, after closing the valve, the valve element and an anchor (the movable element) may not promptly stop to move and the anchor may continue an oscillatory movement. In the configuration in which the anchor and the valve element are movable independently from each other, even after the valve element collides with a valve seat and closes, the anchor continues to move relative to the valve element. Thereafter, it often takes time until the anchor returns to a state allowing the valve to be opened again.

For this reason, in attempting to conduct injection multiple times in a single stroke by reducing the injection interval, the above described time often becomes a constraint. When injection is conducted multiple times in a single stroke and the injection interval cannot be reduced, the period in which injection is not conducted becomes long, and therefore it is inevitably necessary to increase the injection quantity per one injection, or to reduce a total injection quantity, or to set low the range of the rotation speed of an engine that conducts injection multiple times.

When the injection quantity per one injection is increased, the atomization performance of the injected fuel may degrade or a controllable minimum injection quantity may increase, for example. If the total injection quantity in multiple injections is reduced, the engine torque cannot help but being reduced. Moreover, the constraint on the range of the rotation speed of the engine may constrain the range of rotation speed in which the benefit from the multiple injections can be obtained, thus making it difficult to exhibit sufficient performance.

According to the present invention, a drive sequence capable of conducting injection multiple times in a single stroke while suppressing the load on a booster circuit of a drive circuit can be provided, and a great benefit can be obtained particularly for a movable element and a valve element of a fuel-injection valve, the movable element and the valve element being movable relative to each other.

Solution to Problem

According to one aspect of the present invention, an application sequence of a drive voltage is varied between the first injection and the second and subsequent injections so that the energization from a step-up power supply is performed with a smaller power in the first injection than in the second injection. A power supply from the step-up power supply is reduced in the first injection, so that the power consumption from the step-up power supply is suppressed and the load on the drive circuit is reduced. On the other hand, in the second injection, a sufficient power is supplied from the step-up power supply so that the valve can be promptly reopened. In a single stroke, the period prior to the first injection is a relatively long injection-halted period, and therefore the valve does not need to be started to be opened at a short timing from the start of the application of a pulse. Accordingly, even if a time delay from the application of a pulse until the valve element actually opens increases by reducing the power supply from the step-up power supply, no serious actual-harm will occur. On the other hand, in the second injection, because the injection interval between the first injection and the second injection needs to be shortened, a sufficient power is supplied from the step-up power supply so as to promptly reopen the valve.

Advantageous Effects of Invention

According to the present invention, the load on a drive circuit can be reduced while reducing the time until a fuel-injection valve can be opened after a valve element closes. Thus, for example, even when fuel injection is conducted multiple times in a single stroke of a combustion engine, the fuel injection can be conducted at short intervals. The other purposes, features, advantages of the present invention become clear from the following description of the embodiments of the present invention in conjunction with the accompanying drawings.

DESCRIPTION OF EMBODIMENTS

Hereinafter, the embodiments of the present invention will be described.

Embodiment 1

Figure 1:
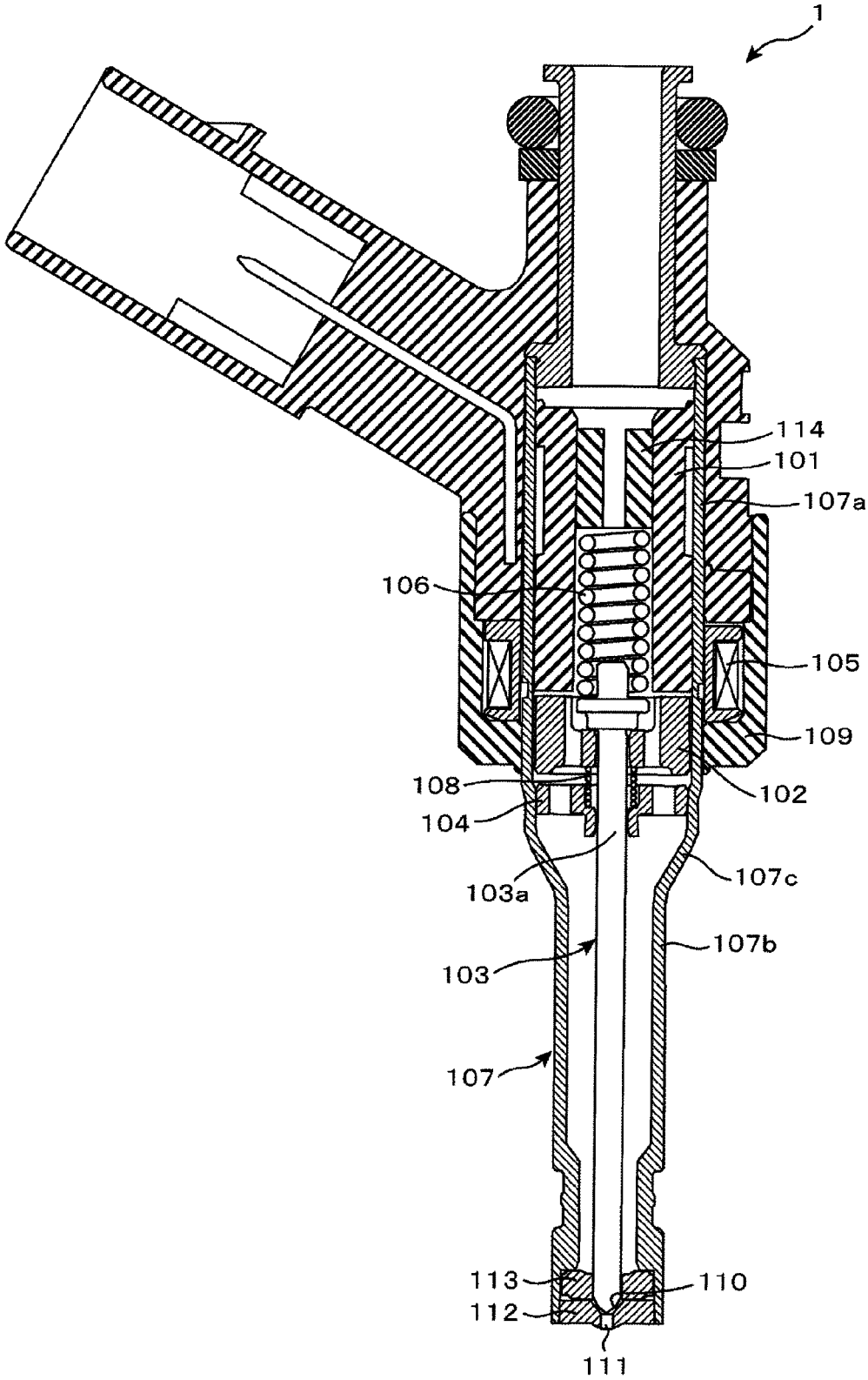
FIG. 1 is a cross sectional view showing an embodiment of a fuel-injection valve according to the present invention.
Figure 2:
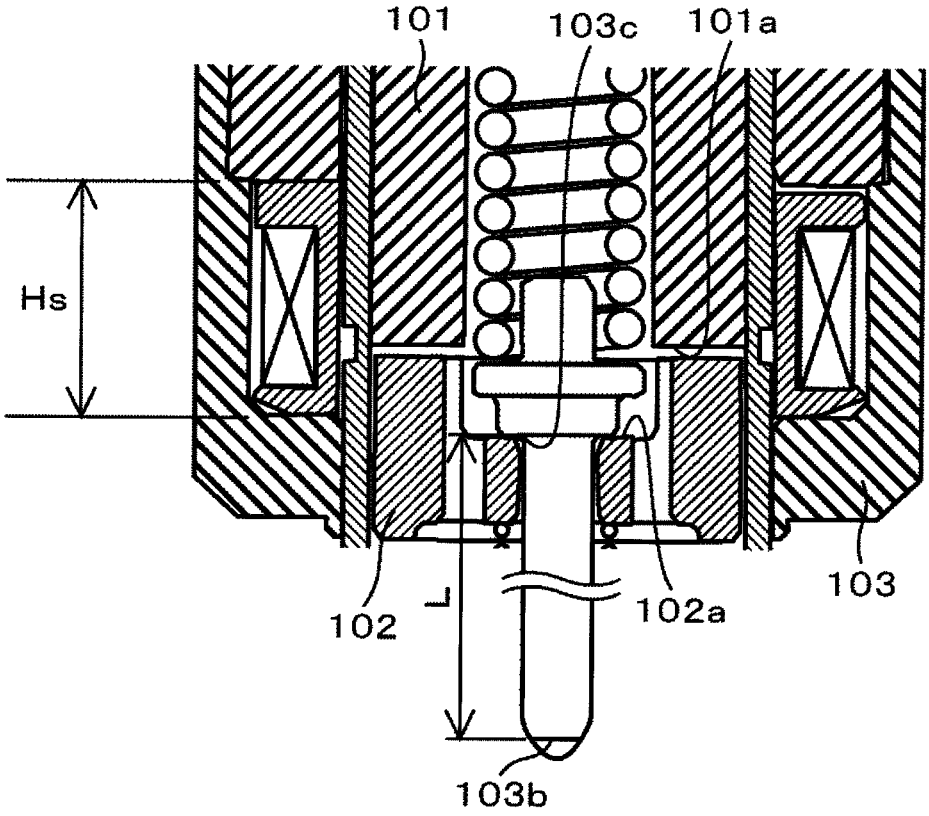
FIG. 2 is a cross sectional view enlarging the vicinity of a colliding section between a movable element and a valve element of a fuel-injection valve according to a first embodiment of the present invention.

FIG. 1 is a cross sectional view of a fuel-injection valve according to the present invention, and FIG. 2 is an enlarged view of the vicinity of a movable element.

A fuel-injection valve 1 includes a housing 107 comprising a large diameter section 107*a*, a small diameter section 107*b*, and a reduced diameter section 107*c* connecting between the large diameter section 107*a* and the small diameter section 107*b*. Inside the large diameter section 107*a* of the housing 107, a magnetic core 101 (a fixed core, or simply referred to as also a core), a movable element 102 (referred to as also a movable core), a first rod guide 104, a biasing spring 106, a zero-positioning spring 108, and a spring presser foot 114 are housed. At an end of the small diameter section 107*b* of the housing 107, a nozzle 112 having a valve seat 110 and an injection hole 111 formed therein is fixed, and a second rod guide 113 is housed inside the nozzle 112. Moreover, a valve element 103 is housed straddling the large diameter section 107*a* and the small diameter section 107*b* of the housing 107.

Outside the large diameter section 107*a* of the housing 107, a coil 105 and a yoke 109 are provided so that the yoke surrounds the coil 105.

The fuel-injection valve 1 shown in FIG. 1 is a normally-close type electromagnetic valve (electromagnetic fuel-injection valve), wherein while the coil 105 is not energized, a seat section 103*b* (see FIG. 2) of the valve element 103 is held in close contact with the valve seat 110 of the nozzle 112 by the biasing spring 106 and thus the valve is in a closed state. Note that the seat section 103*b* is provided at an end of a rod section 103*a* constructed in the valve element 103. In this closed valve state, the movable element 102 is in close contact with a collision surface 103*c* side of the valve element 103 by the zero-positioning spring 108, and there is a space between the movable element 102 and the core 101 (see FIG. 2). The collision surface 103*c* of the valve element 103 is provided at an end on the opposite side of the end where the seat section 103*b* of the rod section 103*a* is formed.

The first rod guide 104 is fixed inside the large diameter section 107*a* of the housing 107 housing the valve element 103, and the first rod guide 104 guides the rod section 103*a* so that the valve element 103 is movable in the stroke direction thereof. Moreover, the first rod guide 104 constitutes a spring seat of the zero-positioning spring 108. The first rod guide 104 is arranged on the nozzle 112 side of the movable element 102 in the stroke direction of the valve element 103.

At the end of the small diameter section 107*b* of the housing 107, the second rod guide 113 is provided, and guides the valve element 103 on the end side (the seat section 103*b* side) of the rod section 103*a* so as to be movable in the stroke direction.

The biasing spring 106 is provided in an inner diameter section of the core 101, wherein the biasing force thereof is adjusted during assembly by a pressed amount of the spring presser 114 fixed to the inner diameter section of the core 101.

The rod section 103*a* of the valve element 103 extends through the inner diameter section of the movable element 102, and the movable element 102 is mounted so as to be relatively displaceable with respect to the valve element 103 in the stroke direction (the axis direction of the rod section 103*a*) of the valve element 103.

The coil 105, the core 101, and the movable element 102 constitute an electromagnet serving as a drive section of the valve element 103. The biasing spring 106 serving as a first biasing section biases the valve element 103 to the reverse direction (valve closing direction) of the direction of the driving force by the drive section. Moreover, a biasing spring 108 serving as a second biasing section biases the movable element 102 to the driving force direction (valve closing direction) with a biasing force smaller than the biasing force by the biasing spring 106.

If a current flows through the coil 105, a magnetic flux is generated in a magnetic circuit comprising the core 101, the movable element 102, and the yoke 109, and the magnetic flux also passes through a space between the movable element 102 and the core 101. As a result, a magnetic attraction force acts on the movable element 102 and when the generated magnetic attraction force exceeds the force by the biasing spring 106, the movable element 102 displaces to the core 101 side. When the movable element 102 displaces, a force is transmitted between a collision surface 102*a* on the movable element side and the collision surface 103*c* on the valve element side (see FIG. 2) and the valve element 103 also displaces at the same time, so that the valve element becomes in an open valve state. The lift amount of the valve element 103 in this open valve state is adjusted by a distance L between the collision surface 103*c* on the valve element side and the seat section 103*b* of the valve element 103 in contact with the valve seat 110 (see FIG. 2).

If the current flowing through the coil 105 is stopped from the open valve state, then the magnetic flux flowing through the magnetic circuit decreases and the magnetic attraction force acting between the movable element 102 and the core 101 decrease. Here, the force by the biasing spring 106 acting on the valve element 103 is transmitted from the valve element 103 to the movable element 102 via the collision surface 103*c* on the valve element side and the collision surface 102*a* on the movable element side. For this reason, if the force by the biasing spring 106 exceeds the magnetic attraction force, the movable element 102 and the valve element 103 displace to the valve closing direction and the valve element 103 becomes in the closed valve state.

Figure 3:
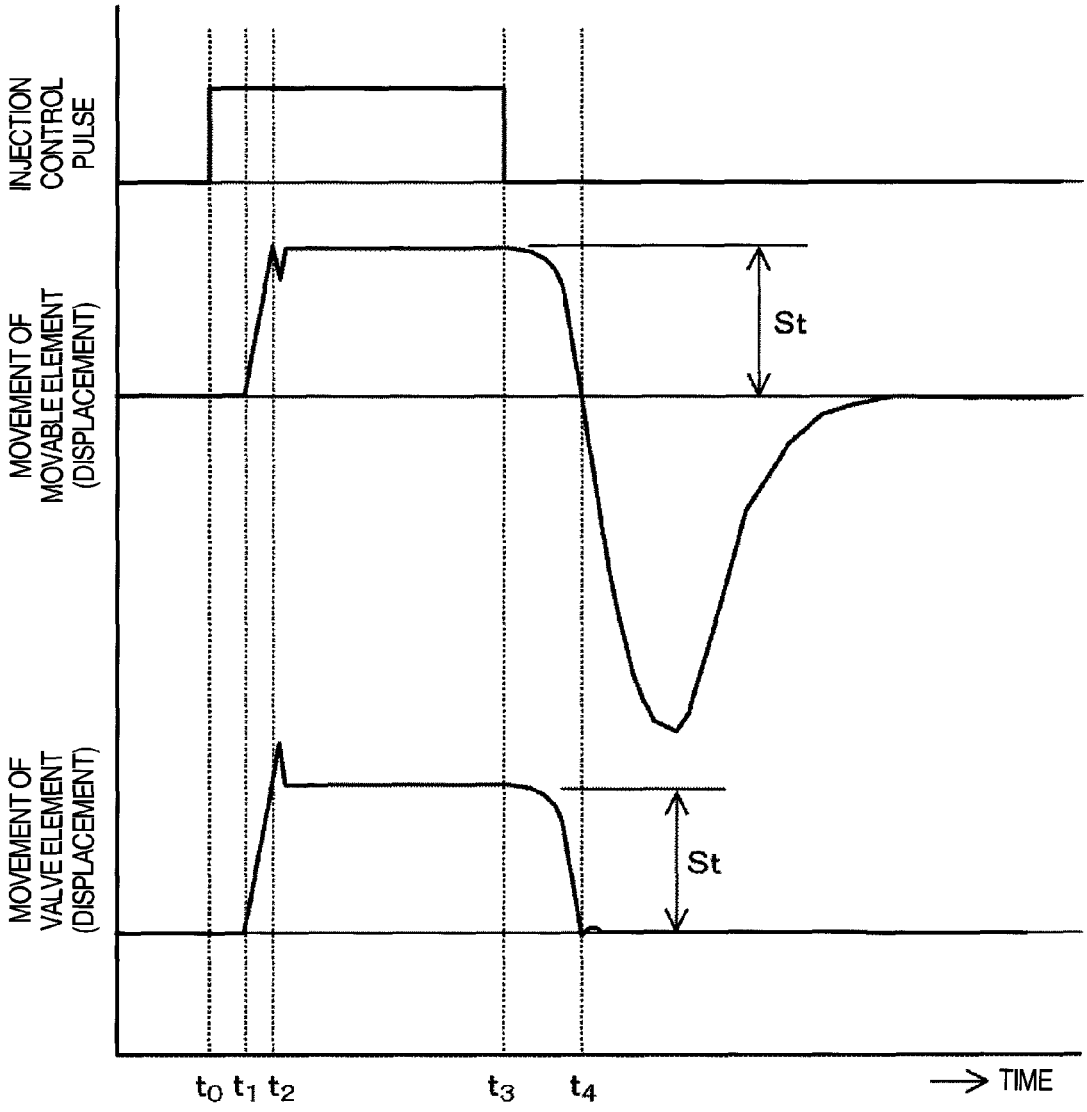
FIG. 3 is a time chart showing movements of a movable element and a valve element of a fuel-injection valve according to a conventional art.

Even after the valve element 103 becomes in the closed valve state and the movement of the valve element 103 stops, the movable element 102 that can move relative to the valve element 103 will continue to move. FIG. 3 is a time chart showing this situation in terms of the displacement magnitude of the movable element 102 and the valve element 103, respectively.

As shown in FIG. 3, after the energization is complete at a time instance $t_3$, the valve is started to be closed, and even after the closing of the valve is complete at a time instance $t_4$, the movable element 102 continues to move. While the movable element 102 continues to move, the distance between the movable element 102 and the magnetic core 101 is large and the valve element 103 is away from the surface against which the movable element 102 abuts. Therefore, even if the energization is started again during the period in which the movable element 102 continues to move, it takes time for the magnetic attraction force to become sufficiently large. For this reason, in order to conduct fuel injection multiple times at close time intervals, a certain waiting time may be required after completing the injection. Moreover, the time interval between multiple injections may be reduced by rapidly supplying a large current. However, in the fuel-injection valve used for a cylinder injection engine, a high voltage is required to supply a large current, and this high voltage is supplied by a high-voltage power supply boosted and stored in the capacitor during a non-injection period. This high voltage is obtained by discharging charges from the high-voltage power supply (by discharging from the capacitor), and therefore when injection is conducted multiple times within a short time period, the storing of charges that is performed after discharging in previously opening the valve may fail to be performed in time and a sufficient effect may be difficult to be obtained. Moreover, if injection is conducted multiple times in a single stroke of the engine, the number of times of charging/discharging from the high-voltage power supply will increase, and accordingly the number of times of operations, the operating time, and the power consumption of the booster circuit will increase and the heat generation in an element will also increase.

If the drive circuit is produced so as to address such a problem, then in order to suppress a voltage drop, there is a need to increase the capacity of the capacitor or to select an electronic device withstanding a large power consumption, or to employ a radiation structure, thus resulting in an increase of the cost or making the implementation difficult.

Then, in the embodiment, the application sequence of a drive voltage from the high-voltage power supply is varied between the first injection and the second and subsequent injections so as to set the power consumption of the high-voltage power supply lower in the first injection than in the second injection.

Figure 4:
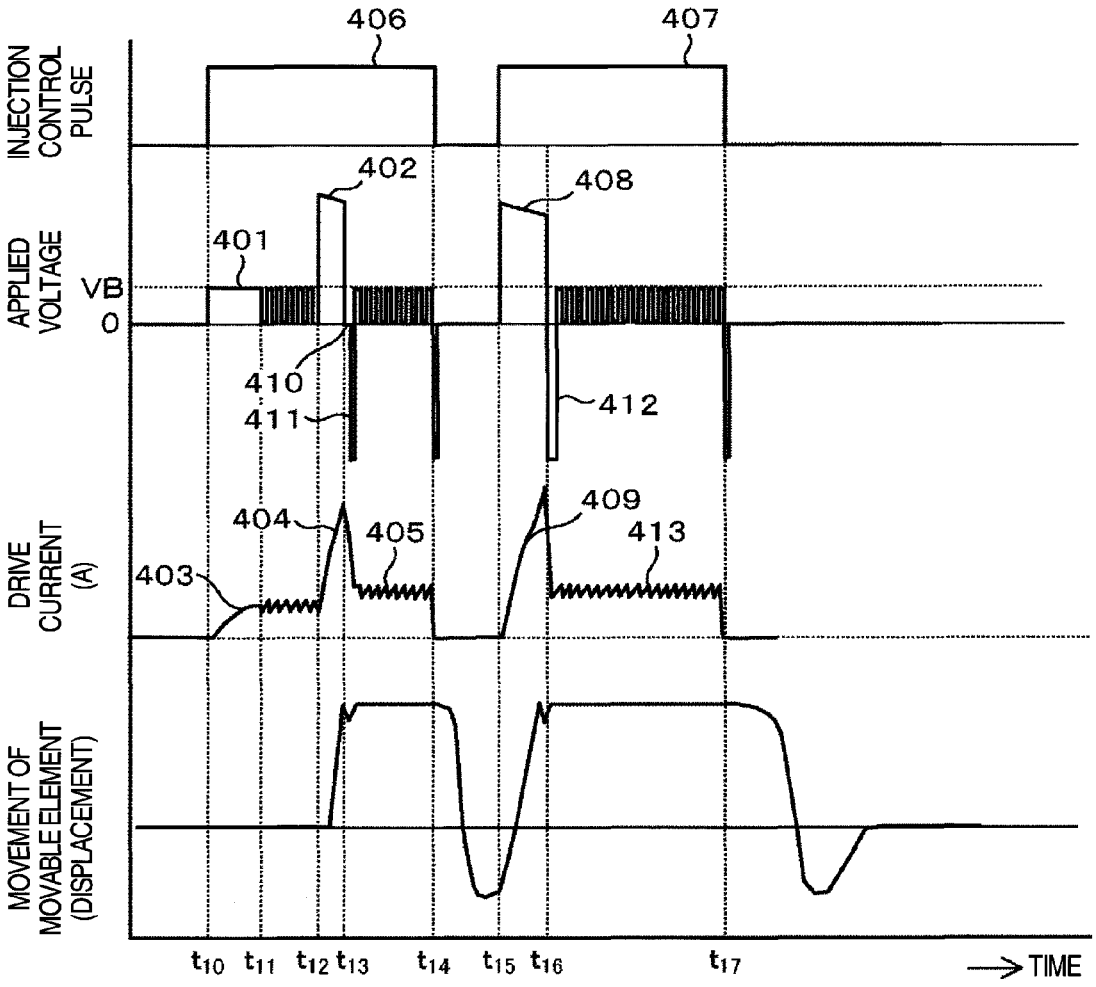
FIG. 4 is a time chart showing a drive current of the fuel-injection valve and a movement of the movable element according to the first embodiment of the present invention.

FIG. 4 is a view showing a fuel-injection valve drive sequence according to the present invention. In the drive sequence shown in FIG. 4, a supply period from the high-voltage power supply is set shorter in the first injection than in the second injection, so that the power consumption of the high-voltage power supply in the first injection becomes smaller than in the second injection. In FIG. 4, the first high voltage application 402 between time instances $t_{12}$ to $t_{13}$ is set so as to have a shorter application period than the second high voltage application 408 between time instances $t_{15}$ to $t_{16}$, and thus the electric power supplied in applying a high voltage requires less.

In the first injection, as in the voltage application 401 of FIG. 4, first in a predetermined period $t_{10}$ to $t_{12}$, the voltage application from an un-boosted battery voltage is performed while controlling the current thereof so as to be a predetermined current value. With a current 403 generated by this voltage application 401, the movable element 102 of the fuel-injection valve does not start to displace and accordingly does not open. In this manner, inside the magnetic circuit of the fuel-injection valve 1, a magnetic attraction force to such a degree to be slightly insufficient for opening the valve is generated in advance, so that even when the current 404 and the power supply from the high-voltage power supply are small, the fuel-injection valve 1 can be easily opened. Moreover, if a magnetic flux is generated inside the magnetic circuit of the fuel-injection valve 1 by the current 403 in advance, the inductance of the coil 105 decreases and thus the rising of the current 404 become quicker than the rising of a current 409 generated by the high voltage application in the second injection. As a result, even when the period of the high voltage application 402 is short, the current required for opening the valve can be supplied by rapidly increasing the current 404.

Moreover, usually, after completion of the high voltage application, a reverse voltage is generated by means of a diode or the like so as to make the current fall down at high speed, as with the applied voltages 411 and 412. Here, in the first injection, a period 410, in which a current is recirculated between the both ends of the coil without applying a voltage, may be provided until the reverse voltage 411 is applied after completion of the high voltage application 402. By recirculating the current without making the current rapidly fall down, the current 404 by the high voltage application can be effectively utilized. By making the falling of the current value gradual, an increase of the magnetic attraction force which rises later than the current can be assisted. In this manner, even when the period of the high voltage application 402 is short, the valve can be opened more stably.

On the other hand, when a voltage is applied by a second injection pulse 407, the period of the high voltage application 408 is set longer than the high voltage application 402 in the first injection. Thus, a drive current 409 can be supplied at as high speed as possible, and even if the movable element continues to move after completion of the first injection, the movable element can be drawn back by a magnetic attraction force to conduct re-injection.

If set in this way, a valve-opening delay time from the start of energization by the pulse 406 to the start of injection will increase in the first injection. However, this problem can be resolved by providing, in advance, the injection pulse at a timing earlier by the amount of the increased valve-opening delay time. On the other hand, when the second injection is conducted after the first injection, more power from the high-voltage power supply than in the first injection can be used, and accordingly even if the injection interval between the first injection and the second injection is reduced, a stable injection operation is possible.

By reducing the injection interval between the first injection and the second injection, the time period in which injection cannot be conducted in a single piston stroke of an engine can be reduced. Also when such a split injection is conducted in a high load region of the engine, the split injection can be conducted even at a high rotation speed because the possible ignition period becomes short.

In this manner, the period, in which a boost voltage is applied, in the first injection is set shorter than in the second injection, so that even if injection is conducted multiple times in a single piston stroke of the engine, a significant increase in the power consumption of the step-up power supply can be suppressed. As a result, the split injection can be conducted even without using a large capacitor, a cooling structure, an expensive electronic device, and the like, or the engine operation range in which the split injection is possible can be expanded.

As described above, as a method of varying the application sequence of a high voltage between the first and the second injections, communication between an ECU (engine control unit) and a driver IC (an integrated circuit for driving) of the fuel-injection valve 1 may be conducted after starting the first injection pulse, and the set value may be changed before the second injection.

Figure 5:
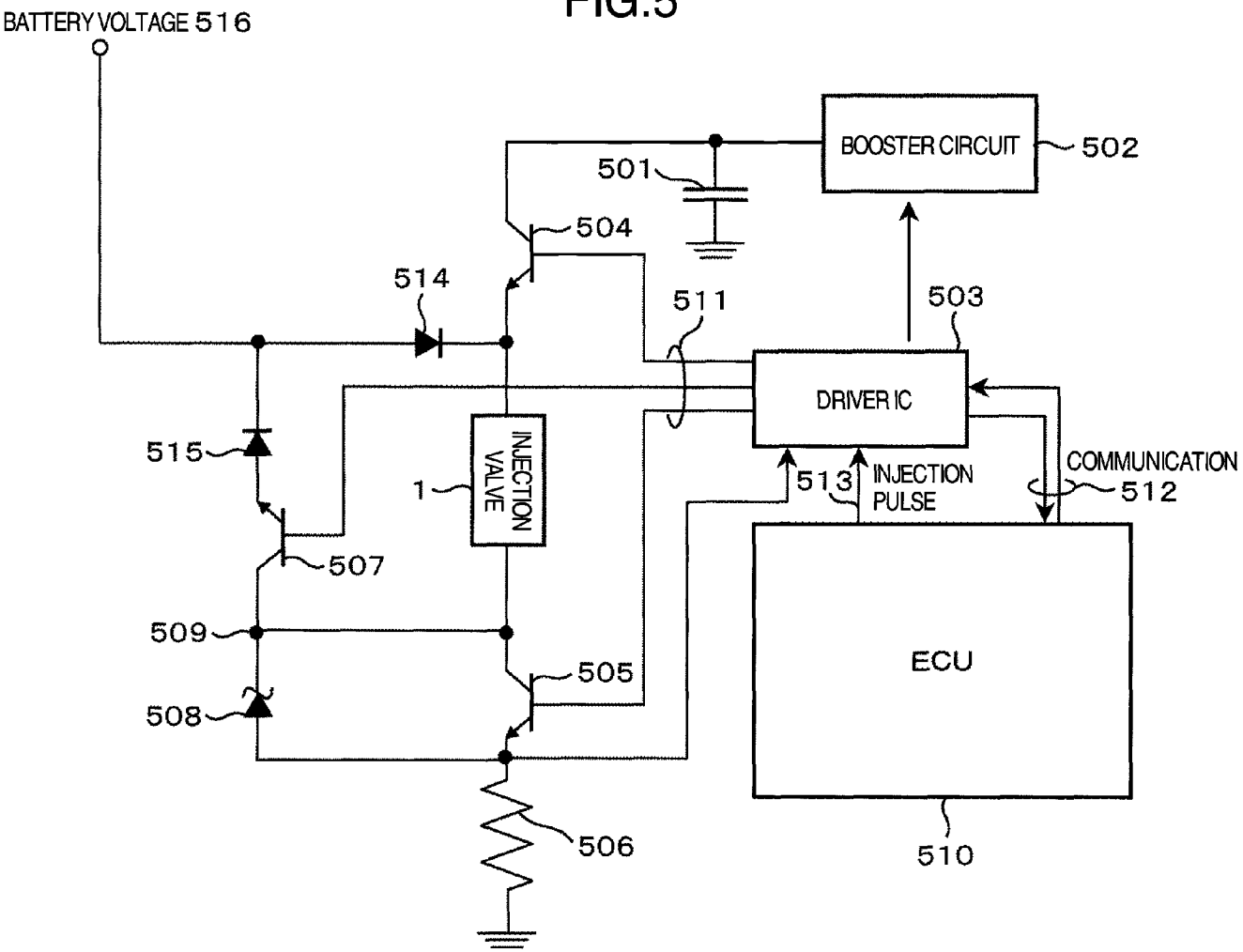
FIG. 5 shows an example of a drive circuit according to the present invention.

As shown as an example in FIG. 5, a driver IC (integrated circuit) 503 of the fuel-injection valve 1 is an integrated circuit controlling the sequence of a drive voltage applied to the fuel-injection valve 1. The driver IC controls switching elements 504 and 505, such as an FET or a transistor, coupled to the fuel-injection valve 1, and a booster circuit 502 so as to conduct the application of a voltage and the drive current control based on a drive sequence that is set in advance through communication with the ECU. As the values that can be set as the drive sequence, a battery voltage application period before applying a high voltage, the current value thereof, the maximum current value when a high voltage is applied and the holding time thereof, and a holding current value for holding the open valve state can be preferably set.

In the case of using such an IC, because a preset drive sequence would be conducted if an injection pulse is input, the first injection and the second injection cannot be distinguished from each other. Then, as described above, an ECU 510 is preferably programmed so that the ECU 510 provides a signal for changing the set value after starting the first injection pulse to the driver IC 503 through communication and the setting is changed prior to the second injection. In particular, under the high load condition of an engine where the injection interval is preferably short, it is possible to take a relatively long fuel injection period and therefore the communication as described above can be relatively easily conducted.

The drive circuit of FIG. 5 is described further in detail. A capacitor 501 is coupled to one terminal of the coil of the fuel-injection valve 1 via the switching element 504, and the booster circuit 502 is coupled to the capacitor 501. The other terminal of the coil of the fuel-injection valve 1 is grounded via the switching element 505 and the resistor 506. A signal line 511 from the driver IC 503 is coupled to the base of the switching elements 504 and 505, respectively, and the switching elements 504 and 505 are individually turned on/off by the signal from the driver IC 503. A communication line 512 is provided between the driver IC 503 and the ECU (engine control unit) 510 serving as the control unit, and furthermore the ECU 510 transmits an injection pulse to the driver IC 503 through a signal line 513. Between the fuel-injection valve 1 and the switching element 504, a battery voltage 515 is coupled via s diode 514. A wiring section between the diode 514 and the battery voltage 515 and a wiring section between the fuel-injection valve 1 and the switching element 505 are coupled to each other via a switching element 507. Note that a diode 515 is provided between the switching element 507 and the wiring section between the diode 514 and the battery voltage 515. Moreover, the wiring section between the switching element 507 and the fuel-injection valve 1 and a wiring section between the switching element 505 and a resistor 506 are coupled to each other via a zener diode 508. One signal line 511 from the driver IC 503 is coupled to the base of the switching element 507, so that the switching element 507 is turned on/off by the signal from the driver IC 503, separately from other switching elements 504 and 505.

Charges are stored from the booster circuit 502 into the capacitor 501. In the period from the time instance $t_{10}$ to the time instance $t_{12}$ of FIG. 4, the battery voltage 516 is applied to the fuel-injection valve 1. In this case, the switching element 504 is turned off and the switching element 505 is turned on. In particular, in the period from the time instance $t_{11}$ to the time instance $t_{12}$, the drive current 403 is maintained at a first set value by repeating the turning on/off of the switching element 505. In the period from the time instance $t_{12}$ to the time instance $t_{13}$, both the switching element 504 and the switching element 505 are turned on. The turning on/off of the switching element 505 is repeated so that the switching element 504 is turned off at the time instance $t_{13}$ and the drive current is maintained at a second set value (reference numeral 405) in the period till the time instance $t_{14}$. In the period from the time instance $t_{14}$ to the time instance $t_{15}$, both the switching elements 504 and 505 are turned off.

In response to an injection control pulse 407, in the period from the time instance $t_{15}$ to the time instance $t_{16}$, both the switching elements 504 and 505 are turned on and a voltage 408 is applied to the coil of the fuel-injection valve 1. In the period from the time instance $t_{16}$ to the time instance $t_{17}$, the turning on/off of the switching element 505 is repeated so that the switching element 504 is turned off and the drive current is maintained at the second set value (reference numeral 413).

As shown in FIG. 5, while the driving of the fuel-injection valve 1 can be conducted using the switching elements 504 and 505, there are a case where the drive current is desired not to be steeply varied such as when the drive current value of the fuel-injection valve 1 is kept constant, and a case where the drive current is desired to be steeply varied such as when the injection control pulse stops. In order to control this, the switching element 507 is used.

Usually, with the switching element 505, when the drive current to the fuel-injection valve 1 is cut off, the potential at a node 509 on the upstream side of the switching element 505 will significantly rise. As the way to manage such a flyback voltage, there are a method of suppressing the flyback voltage by recirculating the flyback voltage to the fuel-injection valve 1, and a method of grounding the node 509 while applying a reverse voltage by means of a zener diode or the like.

In FIG. 5, when the switching element 507 is in the on-state, the flyback voltage is recirculated to the fuel-injection valve 1, and therefore the potential difference between the both ends of the fuel-injection valve 1 will not be reversed and the current will gradually vary. On the other hand, when the switching element 507 is in the off-state, a large flyback voltage is generated and the potential at the node 509 rises. Here, in order to prevent the switching element 505 from being damaged by the flyback voltage, the zener diode 508 is preferably used. If the switching element 505 is turned off when the switching element 507 is in the off-state, then the zener voltage of the zener diode 508 is the potential at the node 509, a reverse voltage is applied to the fuel-injection valve 1, and the current can be promptly varied.

With the use of the fuel-injection valve and the method of driving the same according to this embodiment, the fuel injection can be easily conducted multiple times in a single stroke of the engine, so that a reduction in the emission of soot during a high load, a suppression of the emission of an unburnt hydrocarbon component due to the weak stratified operation during starting or warming-up, and the like can be achieved.

Note that, when injection is conducted three times or more in a single stroke, the power consumption from the step-up power supply in either one of the second and the subsequent injections is preferably set so as to be smaller than the power consumption from the step-up power supply in the first injection. In particular, at a timing when the time interval between injections becomes small, a large power is supplied, so that the minimum injection time interval can be set.

Embodiment 2

Figure 6:
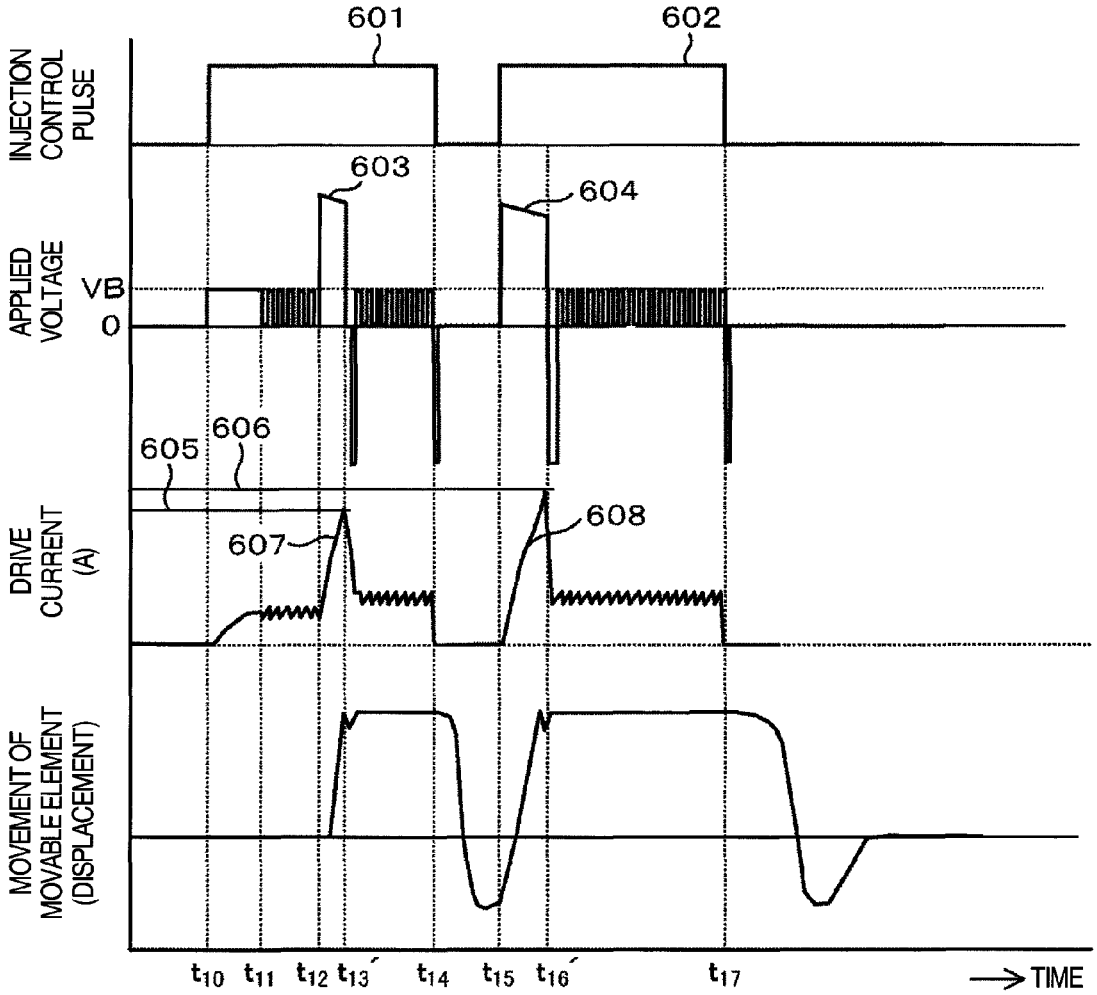
FIG. 6 is a time chart showing a drive current of the fuel-injection valve and a movement of the movable element according to a second embodiment of the present invention.

FIG. 6 is an example of the embodiment of a method of driving the fuel-injection valve according to the present invention. Here, as the method of varying the application sequence of a drive voltage between the first injection and either one of the second and the subsequent injections, the peak value of the current value supplied by the step-up power supply is set so as to be smaller in the first injection than in either one of the second and the subsequent injections In FIG. 6, a fuel injection period ($t_{12}$ to $t_{13}'$) of an applied voltage 603 by the step-up power supply in the first injection is set to a period, within which a supplied current 607 from the step-up power supply reaches a target value 605 of the first peak current.

In terms of circuitry, the potential at the shunt resistor 506 in FIG. 5 is input to the driver IC 503, and the driver IC 503 compares this potential with a set value, thereby determining the application period of the step-up power supply voltage.

In the second injection, the target value of the peak current is set larger than that in the first injection, as with a target value 606, so that the valve can be opened with a lower power consumption in the first injection than in the second injection.

By using the target values 605 and 606 of the peak current in this manner, the application sequence of a drive voltage can be varied between the first injection and the second and the subsequent injections.

The turning on/off of the switching elements 504, 505, and 507 is performed as with Embodiment 1.

Embodiment 3

Figure 7:
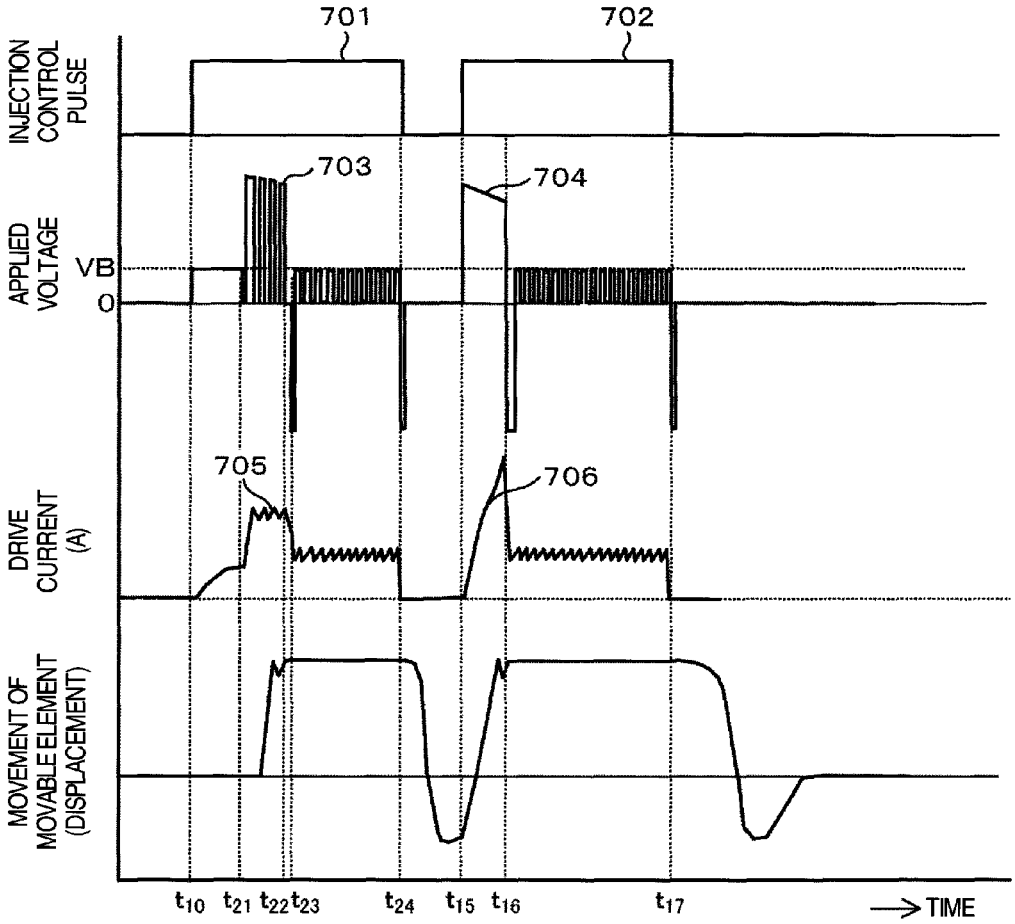
FIG. 7 is a time chart showing a drive current of the fuel-injection valve and a movement of the movable element according to a third embodiment of the present invention.

FIG. 7 is an example of the embodiment of a method of driving the fuel-injection valve according to the present invention, wherein voltage application 703 from the step-up power supply to be applied in the first injection is switched so as to reduce the power consumption more than the power consumption in the voltage application 704 in the second and the subsequent injections.

By applying the voltage supplied from the step-up power supply while switching the same in this manner, the valve element can be opened while keeping the first peak current 705 at a constant value.

By switching, the current supplied from the step-up power supply can be prevented from being excessive and the fuel-injection valve can be opened after the magnetic attraction force rises sufficiently and therefore the first injection can be conducted more stably.

In particular, the current from the step-up power supply can be prevented from reaching an excessive current value, and therefore even if the first injection quantity is extremely small, this injection quantity can be accurately measured and the ignition can be easily conducted.

In the period from a time instance $t_{10}$ to a time instance $t_{21}$ of FIG. 7, the battery voltage 515 is applied to the fuel-injection valve 1. In this case, the switching element 504 is turned off and the switching element 505 is turned on. In the period from the time instance $t_{21}$ to the time instance $t_{22}$, the switching element 504 is turned on and the turning on/off of the switching element 505 is repeated. In the period from the time instance $t_{22}$ to the time instance $t_{24}$, the switching element 504 is turned off and the turning on/off of the switching element 505 is repeated so that the drive current is kept at a set value. The subsequent operation is the same as that of Embodiment 1 or Embodiment 2. The above description has been made with regard to the embodiments, but the present invention is not limited thereto, and it is apparent to those skilled in the art that various kinds of changes and modifications can be made within the spirit of the present invention and the scope of the attached claims.

REFERENCE SIGNS LIST

101 magnetic core
102 movable element (anchor)
102*a* collision surface on movable element side
103 valve element
103*c* collision surface on valve element side
104 first rod guide
105 coil
106 biasing spring
107 housing
108 zero-positioning spring
109 yoke
110 valve seat
111 injection hole
112 nozzle
113 second rod guide
401 application of battery voltage
402 first application of boosted voltage
403 current
404, 409 current by step-up power supply
405 holding current
406, 407, 601, 602, 701, 702 drive pulse

408 second application of boosted voltage
410 current re-circulating period
411, 412 application of reverse voltage for steeply falling down
501 capacitor
502 booster circuit
503 driver IC
504, 505 switching element
506 shunt resistor
603, 604, 703, 704 application of voltage from step-up power supply
605, 606 target value of peak current
607, 608, 705, 706 drive current from step-up power supply

The invention claimed is:

1. A drive circuit for driving an electromagnetic fuel-injection valve, the electromagnetic fuel-injection valve comprising: a valve element that closes a fuel path by abutting against a valve seat and opens the fuel path by separating from the valve seat; a movable element transmitting a force between the valve element and the movable element to conduct a valve opening and closing operation; an electromagnet provided as a drive unit for the movable element, the electromagnet including a coil and a magnetic core; and a biasing unit configured to bias the valve element to a reverse direction of a direction of a driving force by the drive unit, the drive circuit comprising:

a unit capable of applying to the coil a voltage boosted to a voltage higher than a battery voltage; and a unit configured to, when a drive current is provided to the electromagnetic fuel-injection valve so that the electromagnetic fuel-injection valve conducts fuel injection at least two times in a single stroke of a combustion engine, set an application sequence of a boosted voltage different between the first injection and either one of the second and the subsequent injections so that a power consumption by a boosted voltage applied in the first injection is smaller than a power consumption by a boosted voltage applied in either one of the second and the subsequent injections.

2. The drive circuit according to claim 1, wherein the setting unit sets an application period of a boosted voltage so that the application period of a boosted voltage in the first injection is shorter than the application period of a boosted voltage in either one of the second and the subsequent injections, thereby setting so that a power consumption by the boosted voltage applied in the first injection is smaller than a power consumption by the boosted voltage applied in either one of the second and the subsequent injections.

3. The drive circuit according to claim 1, wherein the setting unit, as a method of setting so that a power consumption by the boosted voltage applied in the first injection is smaller than a power consumption by the boosted voltage applied in either one of the second and the subsequent injections, sets a target current value so that a peak value of a current by a step-up power supply in the first injection become smaller than a peak value of either one of currents in the second and the subsequent injections.

4. The drive circuit according to claim 1, wherein when the power consumption by the boosted voltage applied in the first injection is set so as to be smaller than the power consumption by the boosted voltage applied in either one of the second and the subsequent injections, a voltage from the step-up power supply in the first injection is switched and supplied to the electromagnetic fuel-injection valve.

5. The drive circuit according to claim 1, further comprising a driver IC, and a microcomputer different form the driver IC, wherein in the first injection and in either one of the second and the subsequent injections, communication is conducted between the driver IC and the microcomputer so as to vary an application sequence of a drive voltage from the step-up power supply.

6. The drive circuit according to claim 1, further comprising a driver IC wherein the driver IC stores an application sequence of a drive voltage used in the first injection and an application sequence of a drive voltage used in either one of the second and the subsequent injections, respectively.

7. The drive circuit according to claim 2, wherein when the power consumption by the boosted voltage applied in the first injection is set so as to be smaller than the power consumption by the boosted voltage applied in either one of the second and the subsequent injections, a voltage from the step-up power supply in the first injection is switched and supplied to the electromagnetic fuel-injection valve.

8. The drive circuit according to claim 3, wherein when the power consumption by the boosted voltage applied in the first injection is set so as to be smaller than the power consumption by the boosted voltage applied in either one of the second and the subsequent injections, a voltage from the step-up power supply in the first injection is switched and supplied to the electromagnetic fuel-injection valve.

9. The drive circuit according to claim 2, further comprising a driver IC, and a microcomputer different form the driver IC, wherein in the first injection and in either one of the second and the subsequent injections, communication is conducted between the driver IC and the microcomputer so as to vary an application sequence of a drive voltage from the step-up power supply.

10. The drive circuit according to claim 3, further comprising a driver IC, and a microcomputer different form the driver IC, wherein in the first injection and in either one of the second and the subsequent injections, communication is conducted between the driver IC and the microcomputer so as to vary an application sequence of a drive voltage from the step-up power supply.

11. The drive circuit according to claim 4, further comprising a driver IC, and a microcomputer different form the driver IC, wherein in the first injection and in either one of the second and the subsequent injections, communication is conducted between the driver IC and the microcomputer so as to vary an application sequence of a drive voltage from the step-up power supply.

12. The drive circuit according to claim 2, further comprising a driver IC wherein the driver IC stores an application sequence of a drive voltage used in the first injection and an application sequence of a drive voltage used in either one of the second and the subsequent injections, respectively.

13. The drive circuit according to claim 3, further comprising a driver IC wherein the driver IC stores an application sequence of a drive voltage used in the first injection and an application sequence of a drive voltage used in either one of the second and the subsequent injections, respectively.

14. The drive circuit according to claim 4, further comprising a driver IC wherein the driver IC stores an application sequence of a drive voltage used in the first injection and an application sequence of a drive voltage used in either one of the second and the subsequent injections, respectively.

* * * * *